US007452284B2

(12) United States Patent
Pepe

(10) Patent No.: US 7,452,284 B2
(45) **Date of Patent: *Nov. 18, 2008**

(54) GOLF CLUB REST

(76) Inventor: Frank Pepe, 114 Easy St., Murrells Inlet, SC (US) 29576

( * ) Notice: Subject to any disclaimer, the term of this patent is extended or adjusted under 35 U.S.C. 154(b) by 0 days.

This patent is subject to a terminal disclaimer.

(21) Appl. No.: 11/506,046

(22) Filed: Aug. 18, 2006

(65) Prior Publication Data

US 2007/0078025 A1 Apr. 5, 2007

Related U.S. Application Data

(63) Continuation-in-part of application No. 11/240,879, filed on Oct. 3, 2005, now Pat. No. 7,235,022.

(51) Int. Cl.
*A63B 55/10* (2006.01)

(52) U.S. Cl. ..... 473/282

(58) Field of Classification Search ..... 473/282; 248/96–97, 156, 511, 530
See application file for complete search history.

(56) References Cited

U.S. PATENT DOCUMENTS 5,285,990 A * 2/1994 Engel ..... 248/156
5,636,754 A * 6/1997 Ennis ..... 211/70.2
6,383,088 B1 * 5/2002 Kershner ..... 473/282
D517,150 S * 3/2006 MacDowell ..... D21/796
2002/0077190 A1 * 6/2002 Player ..... 473/282

* cited by examiner

*Primary Examiner*—Stephen L. Blau
(74) *Attorney, Agent, or Firm*—Clifford G. Frayne

(57) ABSTRACT

A golf club rest removably securable to the golf bag of a golfer, and utilized to support a plurality of golf clubs in a substantially vertical position when the golfer must venture a distance from the golf cart, the golf club rest comprising a vertical leg portion having a ground engaging end for insertion into the ground, a club support end being an arcuate surface in a horizontal plane perpendicular to the vertical leg portion and covered with a resilient material, an attachment finger secured to said vertical leg portion proximate said second end, the attachment finger spaced apart from the vertical leg a distance sufficient to allow the upper peripheral edge of a golf bag to be slidably inserted there between, the arcuate club support end coextensive with the curvature of the peripheral edge of the golf bag when so positioned thereon.

1 Claim, 4 Drawing Sheets

GOLF CLUB REST

RELATED APPLICATIONS

This application is a continuation in part of application Ser. No. 11/240,879, filed Oct. 3, 2005 now U.S. Pat. No. 7,235,022.

BACKGROUND OF THE INVENTION

1. Field of the Invention

The present invention relates to the sport of golf and in particular, to a portable golf club rest removably securable to the golfer's bag, allowing the golfer to utilize the golf club rest in supporting a plurality of golf clubs when the golfer must venture distantly from the golf cart.

2. Description of the Prior Art

In many instances when playing golf, a golfer will utilize a motorized golf cart to circumnavigate the course. On many courses and in certain climatic conditions, the golf carts are not allowed on the fairways. Many courses adhere to a strict policy of golf cart paths only, which means the golfer must maintain the golf cart on the macadam or concrete path for the entire course of the round. In certain climatic conditions, the fairways are deemed too fragile for the support of golf carts, and the golf cart users are warned to keep the golf carts on the right or left side rough. Still further, when approaching the putting greens, most all courses direct that the golf carts congregate in a particular area adjacent the putting green.

Unfortunately, most golfers are not blessed with the ability to strike their golf shots so that they land in proximity of the golf cart path or the edge of the fairway adjacent the rough where the golf carts are mandated. In those instances, the golfer must walk across the fairway to locate his ball and determine the type of shot that he can hit. Since most golf courses encourage a faster pace of play, the golfer in this situation would normally take two or three clubs with him in anticipation of the shot that he might be able to hit. After choosing the club which he will utilize, he has no choice but to let the other clubs lie on the ground or lean against a tree while he executes the shot. In doing so, the grips become wet from dew during early morning play, and soiled. Still further, if the golfer is executing a shot from deep rough, he may completely forget about the clubs which he has dropped and return to the cart.

The same situation occurs around the putting green where the golf cart parking area is on one side of the green and the golfer's ball is on the other side of the green. The golfer knows that he needs the putter for the putting surface, but does not know whether he needs a sand wedge or a pitching wedge for his approach shot. Therefore, the same condition occurs and the same problems occur around the putting green as well as on the fairway. In the foregoing situations, the golfer is required to bend at the knees or waist to retrieve the clubs from the ground which repetitive motion during the round can be tiresome.

The present invention was developed in order to provide for a portable, light weight golf club rest, which the golfer can easily remove from the golf bag with the clubs he selects when he has to venture a distance from the golf cart in order to determine the type of shot that he has to make and the proper club to use. The golf rest allows the golfer to maintain the extra clubs in an upright position so that the grips do not become wet or soiled. Still further, since they are positioned in an upright position, it is more difficult for the golfer to forget that he has the extra clubs with him when he returns to the cart.

OBJECTS OF THE INVENTION

An object of the present invention is to provide for a novel golf club rest which will support a plurality of golf clubs in a substantially vertical position while the golfer executes a shot with a separate club.

A further object of the present invention is to provide for a novel golf club rest which is light weight and removably securable to the golfer's golf bag.

A still further object of the present invention is to provide for a novel golf club rest which when removably secured to the golfer's golf bag, does not interfere with the golfer's selection of golf clubs or the golfer's access to the various storage areas in the golf bag.

A still further object of the present invention is to provide for a novel golf club rest having a vertical leg which is easily insertable into the ground in order to provide support for a plurality of golf clubs in a substantially vertical position thereby preventing the grips of the golf club from becoming soiled or wet.

SUMMARY OF THE INVENTION

A golf club rest removably securable to the golf bag of a golfer, and utilized to support a plurality of golf clubs in a substantially vertical position when the golfer must venture a distance from the golf cart, the golf club rest comprising a vertical leg portion having a ground engaging end for insertion into the ground, a club support end being an arcuate surface in a horizontal plane perpendicular to the vertical leg portion and covered with a resilient material, an attachment finger secured to said vertical leg portion proximate said second end, the attachment finger spaced apart from the vertical leg a distance sufficient to allow the upper peripheral edge of a golf bag to be slidably inserted there between, the arcuate club support end coextensive with the curvature of the peripheral edge of the golf bag when so positioned thereon.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
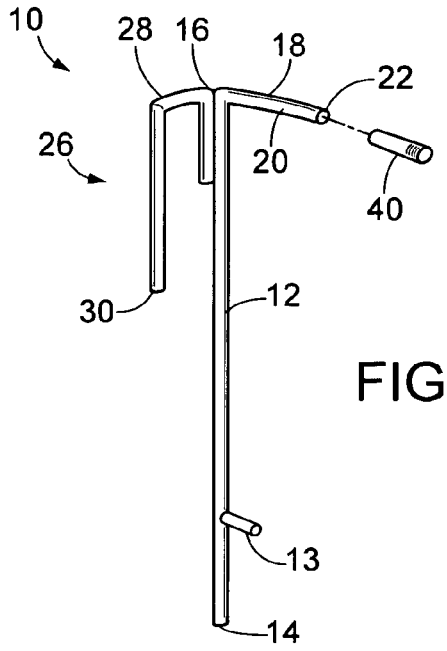
FIG. 1 is a front plan view a first embodiment of the golf club rest of the present invention.
Figure 2:
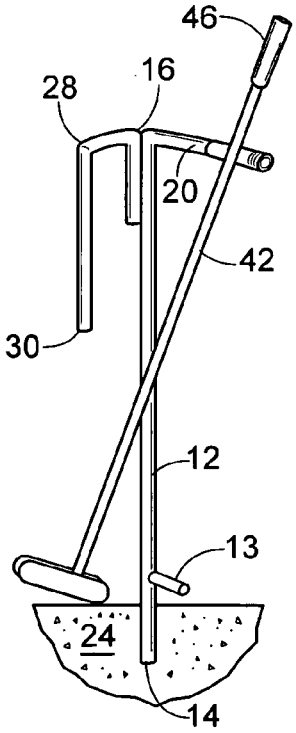
FIG. 2 is a plan view of the golf club rest of FIG. 1 illustrating the support of a plurality of golf clubs.

FIG. 1 is a front plan view of the golf club rest 10 of the present invention, and FIG. 2 is a plan view of the golf club rest inserted in the ground and supporting clubs. Golf club rest 10 is comprised of a vertical leg member 12 having a lower, ground insertion end 14 and an upper end 16 which terminates with a golf rest horizontal arm 18 substantially perpendicular with vertical leg 12, golf rest horizontal arm 18 being arcuate 20 with its juncture with upper end 16 of vertical leg 12. Golf rest horizontal arm 18 serves as a handle for the transport of the golf club rest 10 as well as a handle for the forcible insertion of lower end 14 of vertical leg 12 into the ground 24.

Attached to vertical leg 12 is an attachment arm 26 illustrated as U-shaped in FIGS. 1 and 2. The short leg 28 of attachment arm 26 is junctured at the top end 16 of vertical leg 12, and the longer leg 30 extends downwardly parallel to vertical leg 12. The distance between vertical leg 12 and the longer leg 30 of attachment arm 26 is of a distance sufficient to allow longer leg 30 of attachment arm 26 to be slidably inserted into the interior cavity 32 of a golf bag 34, allowing vertical leg 12 to hang on the exterior of the golf bag 34. Horizontal arm 18 and the arcuate curvature 20 thereof is designed to conform to the circumferential curvature 36 of the golf bag 34 on its exterior periphery so as to provide for compact storage when not in use and not interfere with a golfer's selection of club from the golf bag (See FIG. 3). Preferably horizontal arm 18 would be covered or wrapped with a semi-resilient material 40 such as that used for the grips applied to a golf club to protect the clubs resting thereon.

In operation, when the golfer is faced with the prospect of playing a shot which is a substantial distance from the golf cart and the golf cart cannot be driven to the location of the ball, the golfer would remove the golf club rest 10 from the golf bag 34, select those clubs 42 which he feels he may need in order to execute a shot from the balls position, and walk to the golf ball. The golfer would then utilizing horizontal arm 18, force the lower end 14 of vertical end 12 into the ground 24, thus providing an independent golf club rest 10. After examining the lie of the ball, the golfer can select one of the clubs 42 which he has transported and the other clubs 42 can be leaned against the horizontal arm 18 of the golf club rest 10 in a position so as to not interfere with his swing and the shot. The clubs 42 not used are thus positioned in an angularly upright position which protects the grips 46 from any moisture or dew on the ground and from any exposure to soil. Further, the clubs 42 are in an upright position and easily visible by the golfer such that it is unlikely that he will return to the cart with the selected club in his hand and forget to bring the additional clubs which he has transported.

Upon returning to the motorized golf cart, the golfer can place his golf clubs 42 in the cavity 32 of the golf bag 34 and slide the golf club rest 10 over the peripheral edge 36 of the golf bag 34, long leg 30 disposed internally of golf bag 34 and vertical leg 12 downwardly on the exterior of the golf bag with arcuate horizontal arm 18 conforming to the arcuate periphery of the golf bag 34, thereby positioning it for further use and such that it will not interfere with his subsequent selection of a golf club from the golf bag.

An additional element of golf club rest 10, a foot press 13 secured to vertical leg 12 comprising an extension arm extending outwardly from vertical leg 12 is substantially the same plane as horizontal arm 18 to aid in inserting lower end 14 of vertical leg 12 into the ground by the foot of the golfer.

Figure 3:
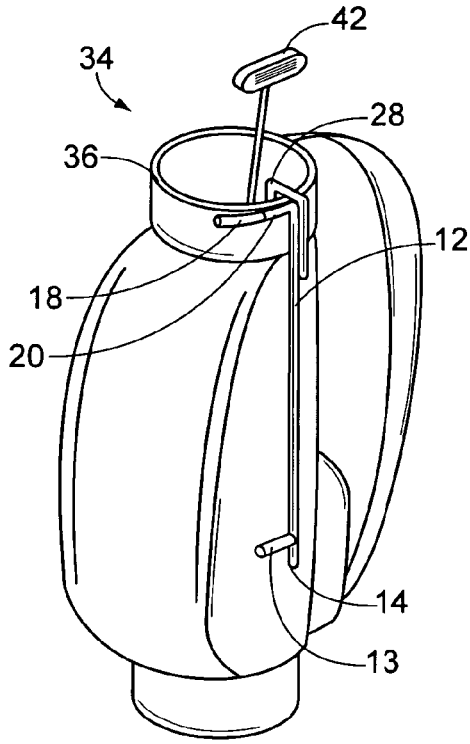
FIG. 3 is a perspective view of the golf club rest of FIG. 1 in its removably secured position with a golf bag.
Figure 4:
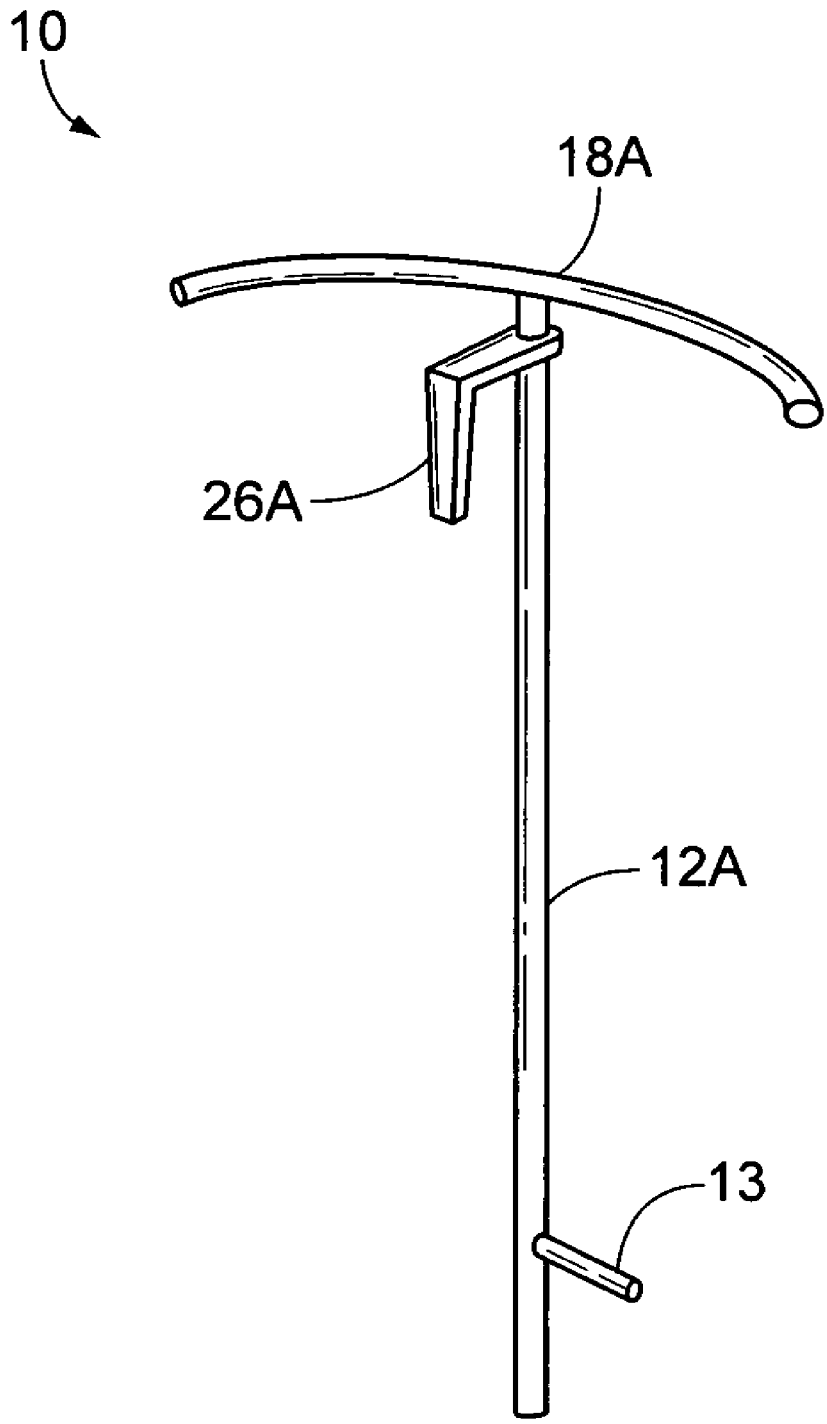
FIG. 4 is an alternative embodiment of the golf club rest of FIG. 1.

The first embodiment illustrated in FIGS. 1, 2, and 3 illustrate the horizontal arcuate arm 18 as being an extension of vertical leg 12 as an elbow bend and attachment arm 26 being a separate U-shaped member. FIG. 4 illustrates an alternative embodiment wherein horizontal arcuate arm 18A extends on both sides of vertical leg 12A with attachment arm 26A extending downwardly therefrom. In this embodiment the legs and arms of the golf club rest would be made of metal, aluminum or the like with the various components secured by weld or the like. The preferred embodiment of the golf club rest as illustrated in FIGS. 4, 5, and 6 allows the upper and lower portions of the golf club rest to be molded of high impact plastic or ABS and connected by a vertical leg member of similar material or metal.

Figure 5:
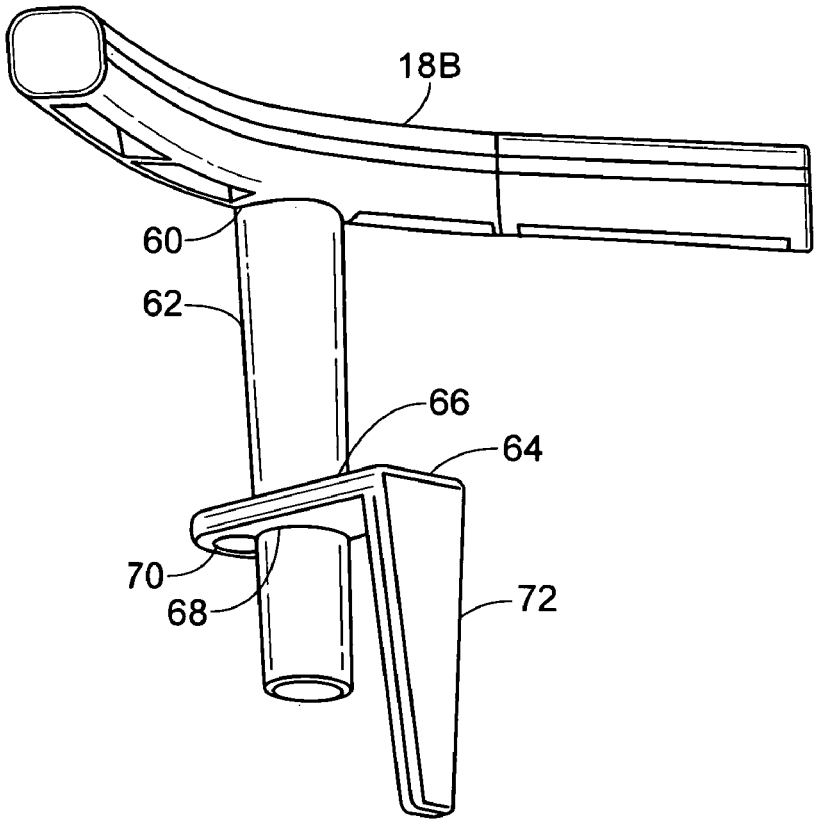
FIG. 5 is a perspective view of the preferred embodiment of the club supporting end of the golf club rest.
Figure 6:
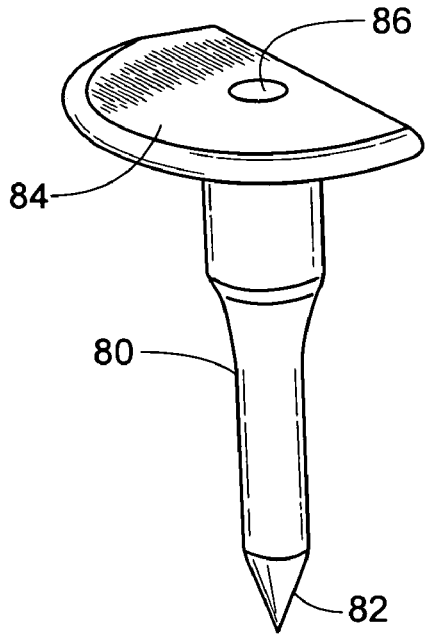
FIG. 6 is a perspective view of the preferred embodiment of the ground engaging end of the golf club rest.
Figure 7:
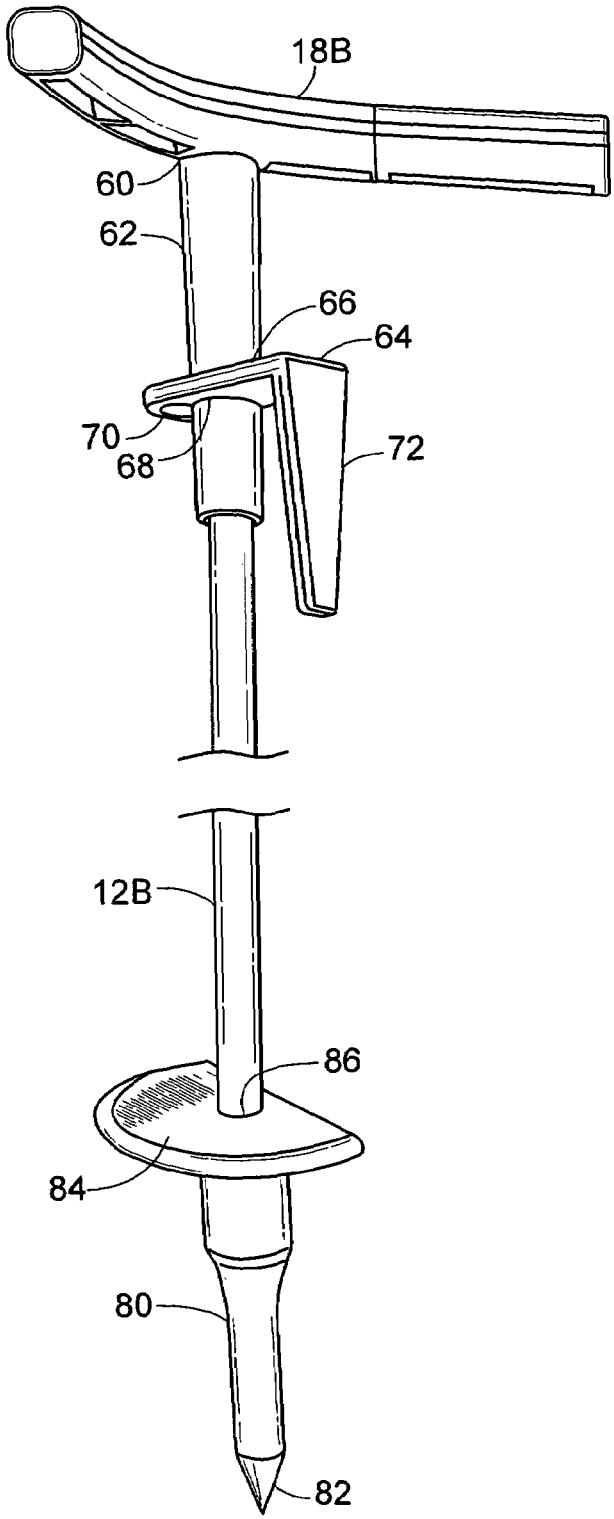
FIG. 7 is a perspective view of the preferred embodiment of the golf club rest of the present invention.

FIG. 5 is a perspective view of the preferred embodiment of the upper end of the golf club rest 10B, FIG. 6 is a perspective view of the preferred embodiment of the lower end of the golf club rest 10B, and FIG. 7 is a perspective view of the preferred embodiment of the golf club rest 10B. In the preferred embodiment, the arcuate horizontal arm 18B is molded of a rigid plastic having a centralized aperture 60 for receipt of a fixedly secured tubular member 62 by means of epoxy or the like. There is positioned on tubular member 62 an L-shaped bracket 64. The horizontal arm 66 of L-shaped bracket 64 has a first aperture 68 slidably receivable over tubular member 62 and affixed thereto by epoxy or the like. Horizontal arm 66 of bracket 64 also is formed with a second aperture 70 which provides a securing means by which a golf towel or other golf accessory may be clipped or secured to the golf club rest 10B.

The depending arm 72 of L-shaped bracket 64 provides for the hook means for securing the golf club rest 10B to the golf bag 34. Vertical arm 72 of L-shaped bracket 64 is disposed a sufficient distance away from tubular member 62 so as to accommodate the peripheral edge 36 of a golf bag 34 between the tubular member 62 and the vertical member 72 of L-shaped bracket 64.

FIG. 6 is a perspective view of the lower portion of the preferred embodiment of golf club rest 10B. It comprises a peg member 80 having an inverted conical portion 82 at its lower end for penetration of the ground. Peg member 80 is depending from a planar foot press member 84 which is secured to peg member 80 or unitarily molded therewith. Foot press member 84 and peg member 80 are formed with a bore 86 which partially extends into the peg member 80.

FIG. 7 illustrates the preferred embodiment of the golf club rest 10B. The top member as illustrated in FIG. 5, and the bottom member as illustrated in FIG. 6 are secured by a vertical leg member 90, which is fixedly secured within tubular member 62 and within the bore 86 of peg member 80.

The operation and use of the golf club rest 10B is the same as that previously described. In the preferred embodiment, construction allows for the arcuate horizontal member 18B and tubular member 62 and L-shaped bracket 64 to be fabricated of molded high impact plastic. It also allows for the peg member 80 and the foot press 84 to also be fabricated in a similar manner. In assembly, the tubular member 62 would be fixedly secured in the aperture 60 formed in the horizontal arcuate member 18B; the L-shaped bracket 64 would be fixedly secured on the tubular member 62; and the vertical leg member 90 would be fixedly secured within tubular member 62 and within the bore 86 of peg member 80. The golf club rest 10B would cooperate with the golf bag in the manner previously discussed and would allow for the golfer to insert the peg portion 80 of the golf club rest 10B into the ground either by applying pressure to the arcuate horizontal arm 18B or by applying foot pressure to the foot press 84.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A golf club rest for supporting a grip portion of a plurality of golf clubs whose head portions rest on the ground, the golf club rest comprising:

an arcuate upper arm oriented in an horizontal plane having a depending arm having a central bore, said arcuate upper arm compatible with the upper peripheral edge of a golf bag;

a tubular shaft member insertibly secured in said central bore of said arcuate upper arm, said tubular shaft member having a bore;

an L-shaped attachment arm having a horizontal leg and a vertical leg, said horizontal leg having an aperture slidably engagable with said depending arm of said arcuate upper arm and secured thereto, said vertical leg member disposed at a distance from said tubular shaft member for engagement over the peripheral edge of said golf bag;

a lower peg member having an inverted conical end for ground penetration and a planar foot press secured to said peg member, there being a tubular bore through said foot press and into said peg member;

a vertical shaft secured in said bore of said tubular shaft member and said bore of said peg member, said vertical shaft of linear dimension such that when said peg member is inserted into said ground, said arcuate upper arm is positioned to support angularly positioned golf clubs.

* * * * *